US005352042A

United States Patent [19]

Roy

[11] Patent Number: 5,352,042

[45] Date of Patent: Oct. 4, 1994

[54] HANDLES MEANS FOR PACKAGES

[76] Inventor: Ron Roy, 102 E. Prospect, Burbank, Calif. 91502

[21] Appl. No.: 87,505

[22] Filed: Jul. 1, 1993

Related U.S. Application Data

[63] Continuation-in-part of Ser. No. 956,672, Oct. 5, 1992, Pat. No. 5,232,287.

[51] Int. Cl.[5] ..... B65D 33/12

[52] U.S. Cl. ..... 383/6; 383/11; 206/223

[58] Field of Search ..... 383/6, 11, 13, 14, 20, 383/21; 206/223

[56] References Cited

U.S. PATENT DOCUMENTS

| | | | |
|---|---|---|---|
| 2,006,786 | 7/1935 | Beauvisage | 383/21 X |
| 2,021,787 | 11/1935 | Janowitz | 383/21 X |
| 3,033,438 | 5/1962 | Glass | 383/20 |
| 3,105,628 | 10/1963 | Mack | 383/20 |
| 3,301,452 | 1/1967 | Jester | 383/20 X |
| 5,232,287 | 8/1993 | Roy | 383/6 |

FOREIGN PATENT DOCUMENTS

| | | | |
|---|---|---|---|
| 2481090 | 10/1981 | France | 383/6 |
| 2633253 | 12/1989 | France | 383/6 |
| 86013 | 4/1936 | Sweden | 383/20 |
| 91586 | 2/1938 | Sweden | 383/20 |

*Primary Examiner*—Allan N. Shoap
*Assistant Examiner*—Jes F. Pascua
*Attorney, Agent, or Firm*—Joseph E. Mueth

[57] ABSTRACT

A packet which enables the user to attach a pair of carrying handles to a package and containing a pair of flexible cords and four plastic members each having a flat surface coated with an adhesive and provided with an adherent protective strippable plastic film thereover covering said surface, and an opposed surface, the opposed surface of each of said plastic members being provided with a raised portion having an opening therethrough for receiving an end of one of said flexible cords. A package having adhered thereto four spaced apart plastic members, each plastic member having an adhesive surface and an opposed surface, two of the plastic members being adhered to one side of the package and the other two adhered to the opposite side of the package, the opposed surfaces of each of the plastic members being provided with a raised portion having an opening therethrough in which is received an end of one of said flexible cords, said flexible cords being adapted to be hand gripped together to provide a carrying handle for said package.

6 Claims, 1 Drawing Sheet

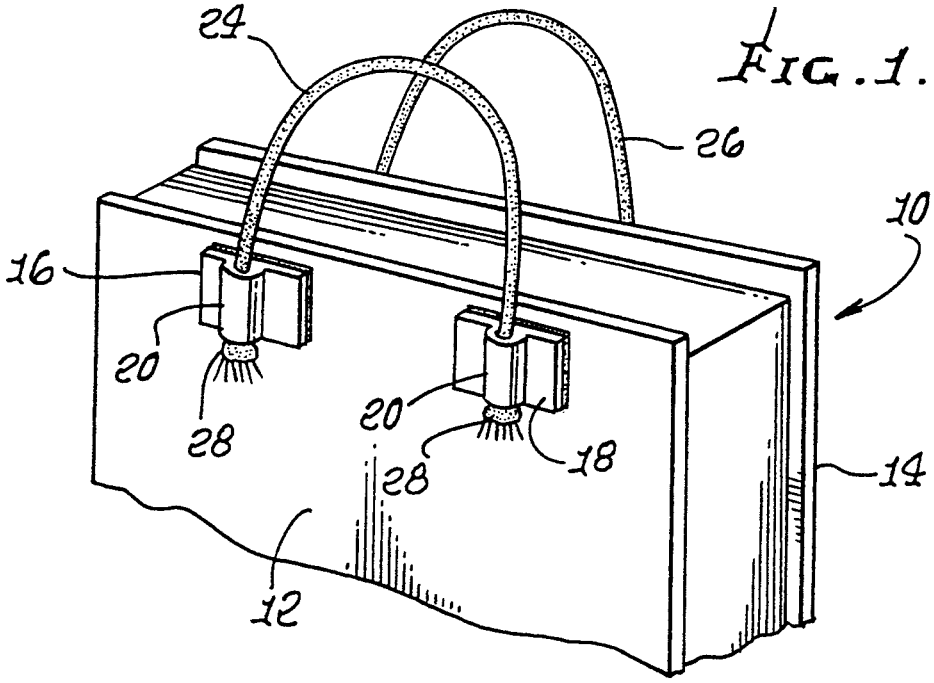
FIG. 1.
FIG. 2.
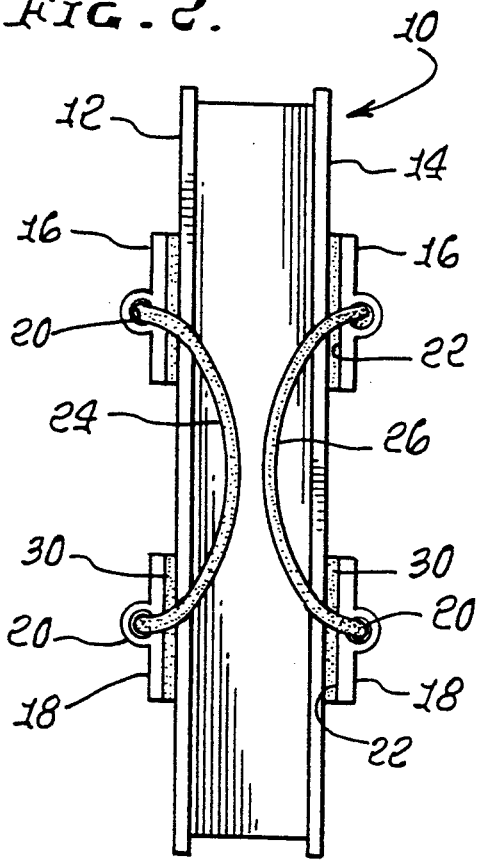
FIG. 3.
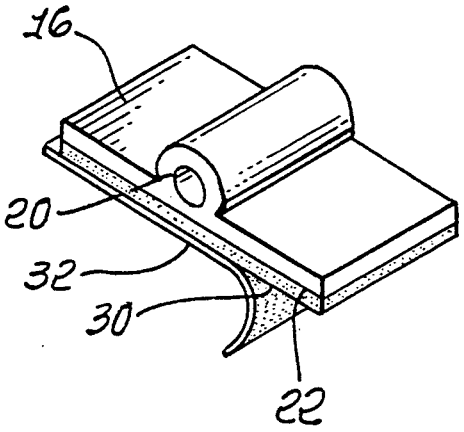

HANDLES MEANS FOR PACKAGES

This application is a continuation-in-part of my U.S. patent application Ser. No. 07/956,672, filed Oct. 5, 1992, now U.S. Pat. No. 5,232,287, the disclosure of which is expressly incorporated herein by reference.

FIELD OF INVENTION

This invention relates to novel packages with handles and the means to apply such handles to packages.

BACKGROUND OF THE INVENTION

Various devices for carrying packages and providing packages with handles are known. The above referenced co-pending patent application discloses a novel package having adhered thereto four pairs of spaced apart adhesive tabs, each tab having opposed adhesive surfaces, two of the pairs of tabs being at one side of the package and the other two at the opposite side of the package, slidably received in the space between each pair of tabs and extending between said two pairs of tabs at each side of the package, a flexible cord, one of said opposed surfaces being adhered to the package and the other opposed surface being adhered to a rigid plastic sheet which bridges the two of the pairs of spaced apart adhesive tabs, the tabs being about the same or slightly thicker than the diameter of said cords, and the flexible cords being adapted to be hand gripped together to provide a carrying handle for said package.

The present invention provides an improved and even more convenient way of providing carrying handles on packages.

It is sincerely believed that this invention is also entitled to a patent.

SUMMARY OF THE INVENTION

Briefly, the present invention comprises a packet which enables the user to attach a pair of carrying handles to a package and containing a pair of flexible cords and four plastic members each having a flat surface coated with an adhesive and provided with an adherent protective strippable plastic film thereover covering said surface, and an opposed surface, the opposed surface of each of said plastic members being provided with a normally integral raised portion having an opening therethrough for receiving an end of one of said flexible cords.

This invention further comprises a package having adhered thereto four spaced apart plastic members, each plastic member having an adhesive surface and an opposed surface, two of the plastic members being adhered to one side of the package and the other two adhered to the opposite side of the package, the opposed surfaces of each of the plastic members being provided with a normally integral raised portion having an opening therethrough in which is received an end of one of said flexible cords, said flexible cords being adapted to be hand gripped together to provide a carrying handle for said package.

It is an object of this invention to provide a novel packet which contains the elements necessary to provide a pair of handles on any package.

It is also an object of this invention to provide an bag or book or the like with a pair of opposed handles by novel means.

It is an important object of this invention to provide means for applying handles to a package in a simple and convenient manner.

These and other objects and advantages of this invention will be apparent from the detailed description which follows.

DESCRIPTION OF PREFERRED EMBODIMENTS

The accompanying drawings are for purposes of illustration and depict the presently known preferred mode for practicing this invention. No doubt, variations on this invention will be evident to those skilled in the art.

FIG. 1 is a perspective view of the novel package of this invention;

FIG. 2 is a top view of the package of FIG. 1;

FIG. 3 is a perspective view of the plastic member which is used in the overall packages shown in FIGS. 1 and 2;

Considering the drawings in greater detail.

In the drawings, the package 10, has adhered to each of its sides 12 and 14 two injection molded spaced apart plastic pieces 16 and 18. Each of these plastic pieces has a raised side with a hole or pass through 20. The opposed side 22 is planar or flat. The cords 24 and 26 are either slidably or fixedly received in pass through 20. The extremities or ends of both cords 24 and 26 are knotted 28 or otherwise enlarged to limit travel of the cords within pass through 20 and, hence, to be secured to the package.

Alternatively, the ends of cords 24 and 26 can be permanently and integrally connected to and formed with the plastic pieces 16 and 18.

The package 10 as shown is a book. The package can also be a bag, box, carton or the like.

The flat, planar surface 22 of each of the plastic pieces 16 and 18 are adhesive coated 30 so that side 22 is adherent to the surface of package 10. In FIG. 2, the adhesive coating is somewhat exaggerated in thickness for purpose of illustration.

The cords 24 and 26 can be woven or twine, plastic, cotton, etc. and, in one preferred embodiment, has a diameter less than the thickness of the holes or pass through 20 so as to be loosely or slidably received in holes 20 as noted above. The knot 28 is larger than said knot 28 to prevent the cord from being pulled out of the plastic pieces 16 and 18. Alternatively, the end of the cords are permanently joined to plastic pieces 16 and 18 and knots are not required.

Considering FIG. 3, FIG. 3 shows one of the plastic pieces prior to application to a package 10. The adhesive coating 30 is present on surface or side 22. The protective strippable flexible plastic sheet 32 cover the adhesive surface and extend slightly beyond the edge of the surface to provide a finger grip for grasping and easy removal when applying the plastic pieces to a package.

The plastic pieces are typically injection molded from plastic and are about 1 inch by 2 inches in size (or larger for heavier loads).

In an alternate preferred embodiment, the cords or handles 24 and 26 are integrally formed with plastic pieces 16 and 18. For example, each of cords 24 or 26 has a plastic piece 16 formed at each of its two ends. The packet of this invention thus contains the two cords with plastic pieces attached. The two cords are otherwise adhered to packages in the manner previously described.

Having fully described the invention, it is intended that it be limited solely by the lawful scope of the appended claims.

I claim:

1. A packet which enables the user to attach a pair of carrying handles to a package and containing a pair of flexible cords and four plastic members each having a flat surface coated with an adhesive and provided with an adherent protective strippable plastic film thereover covering said surface, and an opposed surface, the opposed surface of each of said plastic members being provided with a raised portion having an opening therethrough for receiving an end of one of said flexible cords.

2. A package having adhered thereto four spaced apart substantially rigid plastic members, each plastic member having an adhesive surface and an opposed surface, two of the plastic members being adhered to one side of the package with a flexible cord running therebetween, and the other two plastic members adhered to the opposite side of the package with a second separate flexible cord running therebetween, the opposed surfaces of each of the plastic members being provided with a raised portion having an opening therethrough in which is received an end of one of said flexible cords, wherein said flexible cords do not pass through the sides of the package, said flexible cords being adapted to be hand gripped together to provide a carrying handle for said package.

3. The packet of claim 1 wherein the ends of each of said flexible cords is adapted to be knotted to a thickness greater than the size of the opening.

4. The package of claim 2 wherein the ends of each of said flexible cords is knotted to a thickness greater than the size of the opening.

5. The package of claim 1 wherein each of the flexible cords has one of said plastic members integrally formed to each of its ends.

6. The package of claim 2 wherein each of the flexible cords has one of said plastic members integrally formed to each of its ends.

* * * * *